US006293916B1

(12) United States Patent
Alviso

(10) Patent No.: US 6,293,916 B1
(45) Date of Patent: Sep. 25, 2001

(54) BODY BIOMECHANICS ADJUSTMENT METHOD

(76) Inventor: Todd Alexander Alviso, 17 Chandon, Laguna Niguel, CA (US) 92677

( * ) Notice: Subject to any disclaimer, the term of this patent is extended or adjusted under 35 U.S.C. 154(b) by 0 days.

(21) Appl. No.: 09/325,275

(22) Filed: Jun. 3, 1999

(51) Int. Cl.[7] ..... A61H 7/00
(52) U.S. Cl. ..... 601/134; 601/136
(58) Field of Search ..... 601/134, 136, 601/137, 138, 155, 22, 23, 27, 28; 606/201, 204; 602/66

(56) References Cited

U.S. PATENT DOCUMENTS 1,516,464 * 11/1924 Taplin .
1,981,379 * 11/1934 Thomson et al. ..... 601/27
4,329,981 * 5/1982 Dungl ..... 128/28 B
4,694,831 * 9/1987 Seltzer ..... 128/582
4,852,553 * 8/1989 Voykin ..... 601/134
4,979,240 * 12/1990 Welles ..... 4/254
5,263,474 * 11/1993 Agader ..... 601/134
5,322,056 * 6/1994 Menghi et al. ..... 601/136
5,490,821 * 2/1996 Wu ..... 601/134
6,013,042 * 1/2000 Sakai ..... 601/134

FOREIGN PATENT DOCUMENTS

3228638 * 2/1984 (DE) .
08103482 * 4/1996 (JP) .
11137630 * 5/1999 (JP) .

* cited by examiner

*Primary Examiner*—Justine R. Yu

(57) ABSTRACT

A procedure for self-treating the bony architectural alignment of human feet. The methodology providing a panel with a series of pads thereon to permit adjustment of the bony architecture of a person's feet simply by standing in sequence on the various pads. Preferably the pads are sized and employed to adjust a succession of regions of the arches of the foot medial longitudinal arch, then the lateral longitudinal arch, then the transverse arches, thereby to assist in restoring and maintaining the natural architecture of the foot. Preferably the pads are supported by foam washers enabling the user to add or remove washers to increase or decrease the height of the pads to accommodate a variety of foot types and intensities of desired stimulation.

14 Claims, 2 Drawing Sheets

FIG. 1
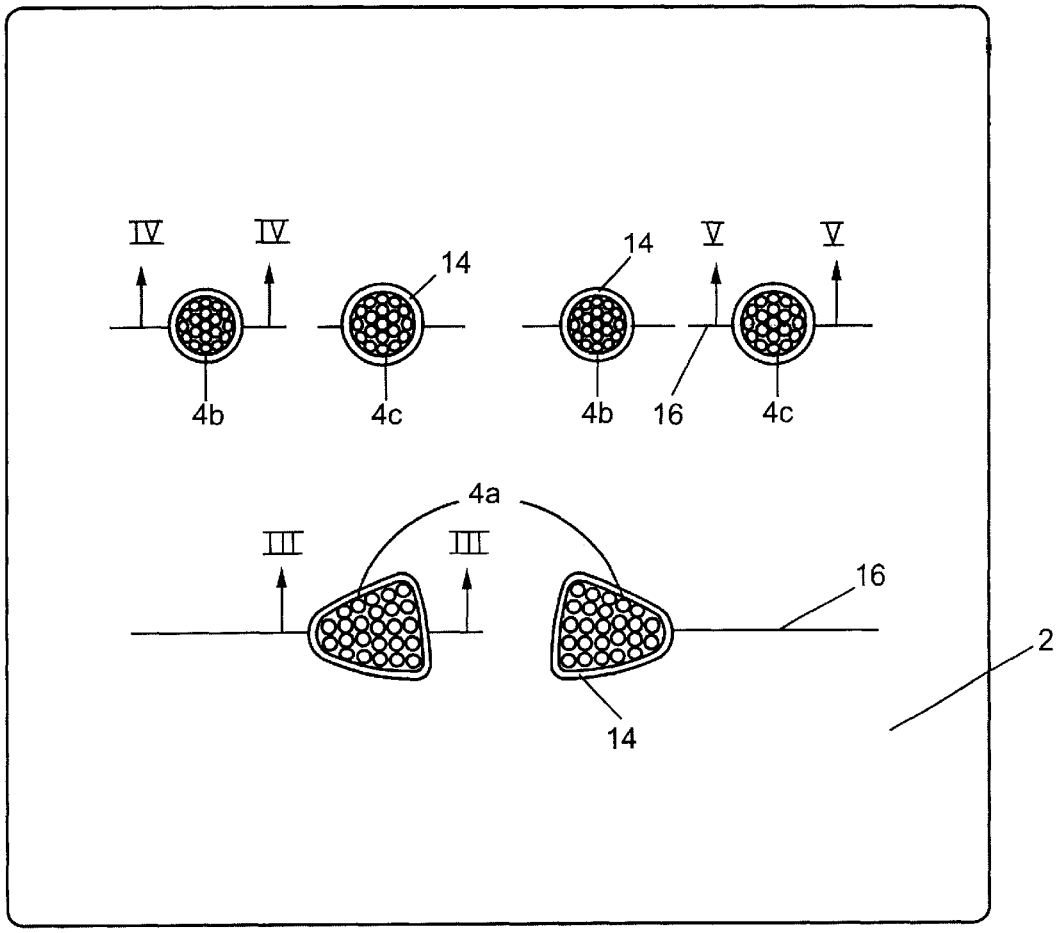
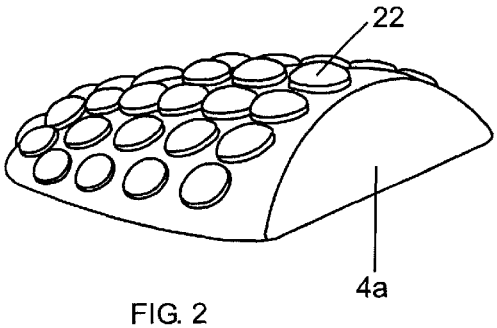
FIG. 2
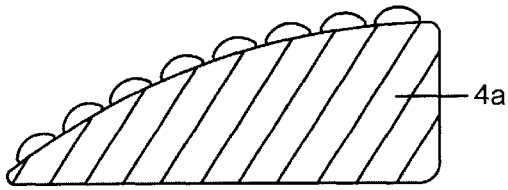
FIG. 3

BODY BIOMECHANICS ADJUSTMENT METHOD

The present invention relates to adjustment devices and a method for use particularly with a human body to assist in restoring and maintaining optimal biomechanical functioning.

As any living body ages, and particularly as a human body ages, it usually experiences a variety of increasingly severe aches and pains. To at least some degree this can be attributed to the aging process. But often such aches and pains result from maladjustments in the biomechanical functioning of the body itself. The bone and muscular structure of the human body has evolved over many thousands of years, and in an environment far different than that typically encountered by most people today. For example, the human foot evolved while waking barefoot on the ground. Now, though most people wear shoes and walk on a hard, flat surface. Both of these conditions are unnatural; the raised heel used as part of most shoes adds to the unnatural forces applied to the foot. Since the body is adaptable, it will strive to adjust to these unnatural forces. Because the heel of the foot is raised by the typical shoe, the muscles and joints above it must adjust; this can lead to significant problems in the ankle, knee, hip, lower back and other biomechanical structures of the body, which in turn often results in what most people view as typical aches and pains.

Such afflictions have been treated in various ways. Modem medicine seems to view them as site specific, and to treat the afflicted knee, lower back or whatever other area happens to be the locus of the pain, often by surgery. Chiropractic treatments usually attribute the pain to a misalignment of the spine or extremities, and therefore manipulate the skeletal and muscular structures to restore proper alignment of these structures. Both such approaches have their advocates, and have experienced success. But they also have experienced failures, too.

The present invention arises out of many years' experience in treating the aches and pains of the human body. Such treatments have imparted what may be a unique view of the biomechanics of the human body. Since the present invention arises out of that understanding, it will be explained in the context of this view of human biomechanics. Whatever the accuracy of that view, though, the invention has been shown through use to be extraordinarily effective. Put differently, the present invention should not be judged by whatever may be the perceived accuracy of the biomechanical understanding here stated, but rather by the effectiveness of the disclosed and claimed structure, device and method.

Experience in treating the aches and pains of the human body using relatively conventional chiropractic techniques led to incorporation into such treatments of techniques of the methodology known as applied kinesiology, often referred to as AK. It is a less forceful treatment methodology than traditional chiropractic, but seems to be at least as effective. AK offers a direct and effective way to gauge the afflicted areas of the body and the results of the treatment by testing specific muscle groups related to the affliction and to the treated areas. Such testing certainly is helpful to the caregiver, it also can be used to make clear to the person being treated the effectiveness of the treatment.

As these techniques developed, it also became clear that the site of many of the body's problems was centered in the feet. With great regularity, a person would be treated to minimize or eliminate the conditions which occasioned the treatment, only to return a short while later with the same condition. Clearly there was some underlying cause that was regenerating the affliction with depressing regularity. It now appears that this cause is centered in, or significantly involves, the feet. They seem to determine to a significant degree the nature of the energy flow in the rest of the body. If they are functioning naturally, which is to say—if they are functioning as they were designed by nature to function, then the rest of the body seems to assume, or readjust to, its natural state. "As below, so above" appears to be quite true in this context. For that reason, how the foot functions seems to be critical to the biomechanical functioning of the rest of the body.

The structure of the human foot, and the ligaments, tendons and muscles that affect functioning of the human foot, have been known for a long time. In general, the foot consists of three groups of bones, the large tarsal bones (the talus or ankle bone and the calcaneus or heel bone) the small tarsal bones, and the long anterior bones (the metatarsals and phalanges). In their normal orientation, these bones and their associated ligaments, tendons and muscles hold the foot in a position that exhibits various arches, including the medial longitudinal arch (extending from the large tarsal bones along the medial length of the foot across the small tarsal bones to the metatarsal bones), the lateral longitudinal arch (extending generally longitudinally across the small tarsal bones of the foot and their connection to the metatarsal bones) and the metatarsal transverse arch (extending generally transversely across the metatarsal bones and their connection to the phalanges up to the small tarsal bones). For the foot to function as intended by nature, all of these arches must be free to respond to the pressures exerted during walking. The modem shoe does not permit this, however, which in turn seems to be a significant cause of biomechanical problems in the human body. In addition, the modern shoe includes a heel, which exacerbates such biomechanical problems. Certainly these problems can be minimized by a proper shoe design (or by simply waling barefoot on appropriate surfaces). But if one has worn a modern style shoe for any significant period, and particularly if one is experiencing biomechanical problems, simply using the correct shoe or walking barefoot, very likely will not eliminate those problems. The foot needs to be retrained into its natural position and functioning. This in turn requires freeing it from the unnatural, constrained state imposed on it by the modern shoe, and very likely considerable repetition of this treatment until the foot has regained and is stable in its natural state. Such treatments need to be performed regularly—a few times a day, for example—for optimal results. Expecting a person to visit a chiropractor or other treatment provider that often is unrealistic.

A way to permit a person to manipulate their own foot, especially its arches, is needed for these reasons. But until this invention there was no way for a person to self-treat their own feet. Indeed, in the past few perceived the desirability of such treatment.

An object of the present invention is to provide a methodology for treating a person's feet to optimize the biomechanical functioning and energy balances of the person's body.

Another object of the present invention is to provide a device and methodology for a person to effectively manipulate their own feet, and particularly to manipulate their feet to optimize the beneficial results that can be obtained by doing so. These and other objects of the present invention will be apparent to those skilled in this field from the following detailed description.

SUMMARY OF THE INVENTION

The preferred device of the invention is designed to assist in the biomechanical adjustment of the human foot. It has an association of pairs of pad surfaces, each of the pair including a first surface for applying pressure to the medial longitudinal arch of a foot, a second surface for applying pressure to the lateral longitudinal arch of a foot, and a third surface for applying pressure to the transverse arch of a foot. Preferably each surface is provided by a different pad, and sufficient pads are provided and located to apply pressure simultaneously to both feet while the person being treated is standing on the pads. Also, in the preferred construction of the device the pads are attached to a resilient floorboard or panel, and are movable to permit the spacing between the pads to be adjusted to approximate the distance between the hip joints of the user.

A second embodiment of the device employs only a pair of pad, each pad having a surface of a size and shape to permit application of pressure to the surfaces previously stated. The pair of pads are connected together and adjustable along a strap to permit them to be spaced to approximate the distance between the hip joints of the user.

The preferred method of treating the bony architecture of the human foot uses at least one pair of raised pads. It includes the steps of applying a definite but comfortable pressure to the medial longitudinal arch to each of the user's feet, and then applying a definite but comfortable pressure to the lateral longitudinal arch of the user's feet, and then applying a definite but comfortable pressure to the transverse arch of each of the user's feet, thereby to effect an adjustment of the foot's bony architecture. Preferably the user stands on both pads of the pair at the same time to simultaneously treat both feet. Also, preferably the pads are of a size, relative to the feet to be treated, that they apply pressure to only a portion of the arch, and the user stands on them to apply pressure to a first portion of the arch, then to a second portion of the arch, then to a third portion of the arch. Further, it is preferred that the user, when employing the treatment method of the invention and uses pairs of pads, first removes the foot corresponding to the handedness of the user from its pad before removing the other foot from its pad of the pair. By using the pads in this preferred manner, the user obtains maximum benefit from the treatment.

BRIEF DESCRIPTION OF THE DRAWINGS

The invention will be further described in connection with the accompanying drawings in which:

FIG. 1 is a plan view of a first embodiment of the invention;

FIG. 2 is a perspective view of one of the pads used in the device shown in FIG. 1;

FIG. 3 is a cross-sectional view of a pad taken on lines III—III of FIG. 1;

DETAILED DESCRIPTION

In its simplest, most basic form, the invention provides at least one pair of pads on which the user stands to treat particular portions of the bony architecture of the user's feet. Preferably, a plurality of pairs of pads of a certain size relative to the size of the user's foot are provided; the pads are used in a particular manner to manipulate the structure of various of the arches of the foot to achieve the significant benefits associated with realignment of the foot's structure to its normal or natural architecture.

A preferred form of the device for achieving such treatment is shown in FIG. 1. It consists of a floorboard or panel 2 with a series of pads 4 mounted thereon. Preferably the floorboard is a sheet of crosslinked polyethylene foam, or polyolefin or minicel closed cell foam, the sheet being about ¼ to ½ inch thick and of an overall size of about 28 inches by 30 inches. The density of the foam should be such that standing on it is comfortable—the foam gives somewhat to cushion the foot—but during use the pads apply an adequate pressure to the arches, as described herein, and the foam readily resumes its flattened panel shape when the user steps off it. A foam density of about 2 to 8 pounds per cubic foot is satisfactory.

Preferably three pairs of pads of a fairly rigid foam or rubber are provided, pad pairs 4*a,* 4*b* and 4*c*. Pads 4*a* are shaped generally like the toe opening of a shoe; a perspective of one of pads 4*a* is shown in FIG. 2, and a lateral cross-sectional view through lines III—III of FIG. 1 is shown in FIG. 3. In general, pads 4*a* are shaped to approximate half of a cone with a rounded top. In the preferred device each pad 4*a* is about ¾ of an inch thick at its maximum, about 2¾ inches long, and about 2½ inches wide.

Figure 4:
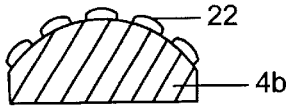
FIG. 4 is a cross-sectional view of a pad taken on lines IV—IV of FIG. 1.
Figure 5:
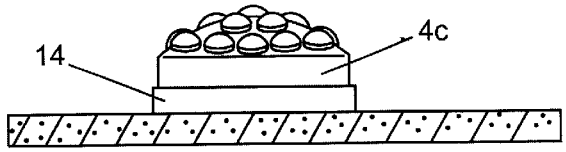
FIG. 5 is a view partly in cross-section and partly in elevation, of a portion of the device taken on lines V—V of FIG. 1.

Each of pads 4*b* and 4*c* are shaped generally like a portion of a sphere, as shown in cross-section in FIG. 4 and in perspective in FIG. 5. Pads 4*b* are somewhat smaller than pads 4*c* for a reason that will be stated shortly. The width of pads 4*b* is about 1⅛ inches, and their height is about ½ an inch. The width of pads 4*c* is about 1¾ inches, and their height is about ⅝ of an inch. On the upper surface of each of pads 4*a,* 4*b* and 4*c* preferably is a series of projections or protuberances 6, each being generally rounded or spherical in shape. A ¼ inch hemisphere is satisfactory for each of these protuberances. Of course, different sized or shaped protuberances may be used, and might be preferred by others. The protuberances assist in applying pressure to the portion of a foot that rests on the pad, permitting tissue to settle into the spaces between the protuberances while allowing the protuberances to apply pressure to the muscles, tendons and bones of the foot. In this fashion, the pads and their upper surfaces stimulate the musculature associated with the arch over the pressure point to return to its natural or intended form in the foot.

Preferably the pads are attached to the floorboard, each by a piece of double-sided tape, or a piece of single sided tape with appropriate cooperating Velcro portions. The pads should be located generally as shown in FIG. 1, each pair of pads being far enough away from the other pairs to permit their use in a manner to be described shortly. An appropriate location for pads 4*a* positions them along a horizontal line about 9 inches above the lower edge of floorboard 2. Pads 4*b* should be about 18 inches above the lower edge, and pads 4*c* about 18 inches above the lower edge. The pads of each pair are spaced apart a distance approximating the distance between the user's hip joints, thereby to allow the user to stand directly over the pad pairs during treatment, and causing the applied force to be oriented in line with the user's body architecture.

Larger, heavier people require a greater force to be applied to their feet to achieve the recommended definite, significant but not uncomfortable pressure exerted by the pads. In general the recommended force applied to the user's feet is proportional to the user's weight, which in turn is proportional to the musculature and bone sizes of the user's feet. Thus, using the weight of the person standing on the pads to provide the force applied to the user's feet offers a natural, clear advantage. Also, the direction of the applied force should in general be perpendicular to the sole of the foot. Again, requiring the person to stand on the pads, which in turn are supported on a floor, achieves this orientation in a simple, natural fashion.

The pressure applied to the user's feet by the pads during use should be significant but not uncomfortable. Since different user's have different size feet, both in outer shape and in their inner structures, it is desirable to permit the user to increase the height of one or more of the pad pairs to achieve the stated pressure during use of the pads. One or more foam discs 14, shown most clearly in FIG. 5, may be positioned between the bottom surface of a pad and the top surface of floorboard 2, thereby to raise the height of the pad to an appropriate position. Each disc may be about ¼ inch thick and of a density of about 2 to 8 lbs./cu. ft. Pieces of double-sided tape or equivalent attachment means may be employed to attach the pad to a disc and the disc to the floorboard.

Preferably, to assist the user in properly locating their feet during a treatment, the floorboard 2 includes appropriate indicia 16 to locate the pads even while covered by the user's feet.

To use the preferred device, first the pairs of pads are positioned appropriately spaced from one another as previously described. Once all three sets of pads are appropriately positioned, the user proceeds to employ the pads to achieve an adjustment.

Figure 6:
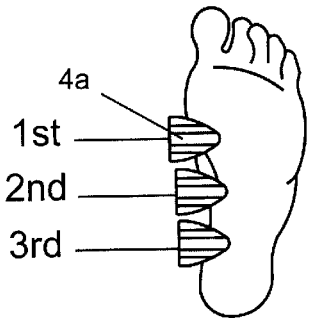
FIG. 6 is a diagrammatic view showing the orientation of a foot during use of one of the pad pairs.

First, the user stands on pads 4*a* with each pad bearing on the user's medial longitudinal arch, the left pad on the left arch, the right pad on the right arch, each foot being turned outward as comfortable, normally about 7 to 15 degrees. The pads are sized such that they will only bear on a portion of the arch. In a first position, the user stands on pad pairs 4*a* with each pad being located under the foot's joint between the first metatarsal and first cuneiform bones. The height of these pad pairs increases from an outer minimum to an inward maximum. The user stands on the pads so that each applies significant pressure to the foot, but not an uncomfortable pressure. The first position, the relation of pad 4*a* to the user's left foot, is shown in FIG. 6, the position being marked "1st." The user should remain standing with each foot in this position on its pad for 10 to 15 seconds, or the amount of time required to take two to three normal breaths.

Next the user shifts the position of his or her feet on pads 4*a* so that, in a second position, the pads bear on the user's navicular bone. Preferably, each time the user changes position on the pads, if the user is right-handed the right foot is removed first, then the left foot, then the right foot is placed on the next pad or in the next position, after which the left foot is so placed. If the user is left-handed, the left foot is moved and placed first; in other words, the "handedness" of the user determines the order in which the feet are moved and placed. A foot is appropriately placed on a pad, and the pad height is appropriate, when the location of the foot is as stated and the pressure exerted on the foot by the pad is firm but not uncomfortable. The second position, specifically the relation of pad 4*a* to the user's left foot, is shown in FIG. 6, the position being marked "2nd."

After remaining in the second position for between 10 to 15 seconds, or for two to three breaths, the user moves to a third position on pads 4*a* in which the pads underlie the rear part of the talus bone of the user's feet, and the pads exert the indicated pressure on the foot. This position on the user's left foot is shown in FIG. 6, the position being marked "3rd." The user remains in this position for 10 to 15 seconds. This completes application of an adjustment to the user's medial longitudinal arches.

Next the user steps off pads 4*a,* the handedness foot always being moved first, then onto pads 4*b* such that they are located beneath the joint of the cuboid and calcaneus bones of each foot. They should exert definite but not uncomfortable pressure on each foot. The fourth position, specifically the relationship of pad 4*b* to the user's left foot, is shown in FIG. 7, the position being marked "4th."

After remaining in this fourth position for between 10 to 15 seconds, the user next moves to a fifth position in which pads 4*b* are located under the joint between the fifth metatarsal bone and the cuboid bone. The applied pressure should be as previously stated, and the time of application should be between 10 to 15 seconds. The fifth position, specifically the relationship of pad 4*b* to the user's left foot, is shown in FIG. 7, the position being marked "5th." Of course, the user's right foot is similarly positioned, both in this position and in all the other positions, thereby to use the pad pairs to simultaneously apply pressure to the soles of both of the user's feet.

Figure 7:
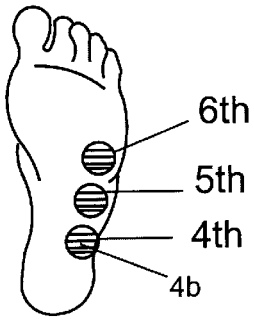
FIG. 7 is another diagrammatic view showing the orientation of a foot during use of a second of the pad pairs.

Next the user moves to a sixth position in which, for each foot, pad 4*b* underlies the center of the fourth metatarsal bone, as designated in FIG. 7 by "6th." Again the applied pressure should be as previously stated and the time in this position should be between 10 and 15 seconds. This completes application of an adjustment to the lateral longitudinal arches of the user's feet.

The next three positions adjust the transverse arches. In a seventh position, the user's feet are moved to pad pairs 4*c,* each pad underlying the center of the second metatarsal bone, as shown in FIG. 8, the position being marked "7th." The applied pressure should be as previously stated, and the position should be held for 10 to 15 seconds.

Figure 8:
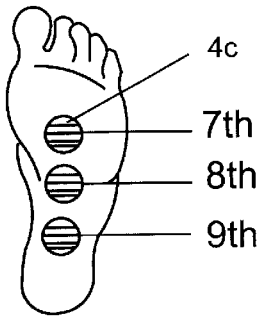
FIG. 8 is a third diagrammatic view showing the orientation of a foot during use of a third of the pad pairs.

The eighth position locates the user's feet such that pads 4*c* are each under the joint between the user's second and third cuneiform bones, as shown in FIG. 8, the position being marked "8th." Again, this position should be held for 10 to 15 seconds, and the pressure applied by pads 4*c* to the feet should be firm but not uncomfortable. In stepping off pads 4*c* to end the eighth position, as in exiting each of the previous positions, the handedness foot is removed first, then the other foot is removed from its pad.

The ninth position locates the user's feet such that pads 4*c* are under the junction of the talus bone, cuboid and calcaneum in each foot, the position being shown in FIG. 8 and labeled "9th." The position should be held for 10 to 15 seconds and the pressure applied should be definite but not uncomfortable. In exiting this position, the handedness foot is removed first, following which pressure is continued to be applied by pad 4*c* to the other foot for between 10 to 15 seconds, after which it is removed to complete the treatment.

Figure 9:
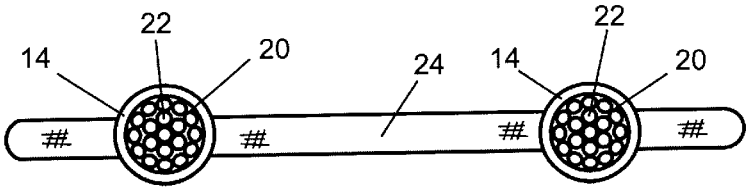
FIG. 9 is a perspective view of a second embodiment of the device.

A second, simplified device for adjusting or manipulating the bony architecture of the human foot is shown in perspective in FIG. 9. It consists of a pair of shells or semi-spherical pads 20, each having a set of protuberances 22 distributed over its upper surface generally as shown, and for the purpose stated with respect to protuberances 6. Each pad may be of a fairly rigid foam material, or of a rubber. In use, and as with the pads of the device shown in FIG. 1, each pad should apply a definite and significant but not uncomfortable pressure to the sole of the user's foot. Since different user's feet are of different size and shape, it is desirable to use this device on a soft, yielding surface such as on a rug, the softness yielding somewhat to accommodate feet of different size. Should greater pressure be desired, one or more discs like disc 14 may be attached to the bottom of pads 20 to raise their upper surfaces relative to the rug on which the device is being used. The pads preferably are connected to one another, such as by strap 24 extending through appropriate slots in each of the pads. The pads may slide along the strap to adjust their spacing to approximate the distance between the user's hip joints. The strap also helps to hold the pads upright with their top surfaces ready to receive the user's feet. To use this device, the user positions each foot on one of the pads, going through positions 1 to 9 as previously described, each position being held for from 10 to 15 seconds. As before, the handedness foot should always be moved first. Also, the last position is held on the non-handedness foot preferably for an extra 10 to 15 seconds.

It may seem, especially to those not attuned to the biomechanics and energy balances of the human body, that these devices are, to say the least, simple. They may even consider them to be of little to no practical use. This, however, is certainly erroneous. Those familiar with AK know that simple muscle tests can quickly and clearly reveal the effectiveness on the human body of many different treatments. Using such AK muscle testing, it can be shown that appropriate treatments will restore the body's natural biomechanics and balances. It can also be shown that unnatural or adverse conditions will upset such qualities, sometimes with surprising speed. By employing such tests, it can be shown that using the preferred device in the manner described previously herein will restore the body's natural biomechanics and energy balances. It can also be shown that using this device but not substantially in the manner described will not restore such qualities. Thus, a treatment proceeding for example through the positions in the order 1, 4, 7, 2, 5, 8, 3, 6 then 9 will not restore such qualities, nor will one proceeding through positions in the order 1, 2, 3, 7, 8, 9, then 4, 5, and 6. Some restoration can be obtained by a sequence of positions 1, 3, 4, 6, then 7 and 9—in other words by omitting or combining positions 2, 5 and 8 with their adjacent positions. Also, some benefit can be obtained by using the full numerical sequence of positions as stated, yet not holding each for the fill 10 to 15 seconds but rather for a shorter period. However, clearly a treatment employing the fill sequence of positions 1 to 9 in numerical order and by holding each position for the fill 10 to 15 seconds is best to achieve the full benefit of the restoration of such qualities available using this method and either of the disclosed devices.

It is important to use each of the devices, and to perform the steps of the method, on a floor that is sufficiently resilient to not negate or substantially reduce the adjustment of the bony architecture of the user's feet. Put differently, it has been found that a foot's bony architecture, and the body's biomechanics and natural energy balances, once readjusted or restored, are instantaneously upset if the person then stands on a hard, flat surface such as concrete or a tile floor. Many shoes also have this effect. On the other hand, when the natural architecture of a person's feet has been restored, if the person then stands on, or walks on, a carpet or a well-cushioned rug. the natural architecture will tend to remain. This is also true if the person walks on dirt, sand or other natural, yielding outdoor surface. Thus, preferably the devices are used when resting on a carpet or the like, and at least for an initial period of time the person who has used either of the devices, or the method, does not walk on a concrete-like surface.

Of course, others may prefer to apply pressure to additional areas of the foot, or in a more elaborate or somewhat different sequence, or using different shaped pads (standing on bottle caps in the order stated has even produced some benefit); experience using the devices of this invention may suggest further treatment modalities or changes to better suit certain conditions or people. But this method and each device is simple, employs the user's own weight and the force of gravity to effect treatment, and because it is self applied it can be employed as often as desired or as necessary. Twice a day, at arising and in the evening, usually will be sufficient. But if unusual or adverse biomechanical stresses have been encountered, or inappropriate footwear has been worn, or if the user has stood for long periods on a hard, flat surface, more frequent use of either device and the method will be desirable. By appropriately repositioning the bony architecture of the feet on a regular basis, the structure and musculature of the foot can be induced to revert to their natural, intended alignments and functioning. This in turn can result in significant improvements in other structures and functions of the user's body.

While preferred devices and a method have been shown and described, as indicated adjustments in the devices or method, or both, may be preferred by other care-givers or users. For that reason, and others, this invention should not be limited to either of the specific devices shown and described, or to the specific treatment stated, but rather is as set forth in the following claims.

What is claimed is:

1. A method for specifically respositioning the bony architectural alignment of human feet using at least one pair of raised pads, each having a pad surface, resting on a sufficiently resilient floor or floorboard surface, the pads and floor or floorboard surface are sufficient to apply the amount of pressures necessary to reposition the bony architectural alignment of human feet, in which each raised pad is of a size sufficient to apply pressure to only a portion of an arch when stepping on the pads, the method comprising the steps of:

(a) using the pad surfaces to substantially simultaneously apply a sequence of definite pressures, sufficient to apply pressure to overlying muscles, tendons and bones of the foot to both medial longitudinal arches of a user's feet beginning the sequence with a forward area approximately underlying the foot's joints between the first metatarsal bones and first cuneiform bones, then further applying at least a second pressure in the sequence to the rearward area of the medial longitudinal arches approximately underlying the talus bones, then (b) using the pad surfaces to substantially simultaneously apply a sequence of definite pressures, sufficient to apply pressure to overlying muscles, tendons and bones of the foot to both lateral longitudinal arches of a user'feet, beginning the sequence with a rearward area approximately located under the joint between the cuboid and calcaneus bones, then further applying at least a second pressure in the sequence to the lateral longitudinal arches approximately underlying the center of the fourth metatarsal bones, then (c) using the pad surfaces to substantially simultaneously apply a sequence of definite pressures, sufficient to apply pressure to overlying muscles, tendons and bones of the foot to both transverse arches including the longitudinal center of a user's feet, beginning the sequence with a forward area approximately located under the center of the second metatarsal bones, then further applying at least a second pressure in the sequence to the rearward area of the transverse arches approximately underlying the junction of the talus bone, cuboid, and calcaneum bones, then (d) ending the method using one of the pad surface to apply a unilateral final definite pressure, sufficient to apply pressure to overlying muscles, tendons and bones of the foot, to the region approximately underlying the junction of the talus bone, cuboid and calcaneum of the user's non-handedness side of the body's foot or the contralateral foot of the handedness side of the body, whereby the intensity and duration of the applied pressures are adequate to reposition the bony architecture of the feet effected by the method.

2. A method as set forth in claim 1 including the step of applying pressure to the arches of the user's feet by standing on the pair of pad surfaces, whereby foot alignment is substantially improved as evidenced through applied kinesiology manual muscle testing procedures.

3. A method as set forth in claim 1 providing a plurality of pairs of pad surfaces, each pad surface being shaped and sized to apply pressure to a particular arch portion, and in which the pad pairs are used in sequence to apply pressure to a succession of arches of a user's feet, including standing on the pads at least at a forward portion and rear portion of each arch for a given period of time.

4. A method as set forth in claim 1 providing protuberances on the pad surfaces which will engage the bottom surface of human feet, whereby the bony architectural repositioning is facilitated through a stable contact.

5. A method as set forth in claim 1 providing an elevation means to adjust the height of the pad surfaces relative to the floor or carrier surface, thereby to apply the given pressures to a variety of foot types.

6. A method as set forth in claim 3 providing a carrier means which is a sufficiently resilient floorboard of a size to permit the pairs of pad surfaces to be spaced apart sufficiently to permit pressure to be applied sequentially by each of the pairs of pads to the arches of the foot without interference from any other of the pairs of pad surfaces located on the floorboard.

7. A method as set forth in claim 1 in which the pads rest on a floor surface or floorboard carrier means which is a cross-linked polyethylene foam sufficiently resilient to substantially maintain the adjustment of the bony architecture of the feet effected by the method when standing upon the pads.

8. A method for assisting in the biomechanical adjustment of human feet, using a plurality of raised pads in which each pad is of a size sufficient to apply pressure to only a particular portion of an arch when standing upon the pads, the method comprising:

(a) providing a substantially resilient carrier means for holding the pads spaced from one another approximately the distance between the hip joints of a human, and (b) providing pads being shaped to apply pressure to the medial longitudinal arch of a foot, and to the lateral longitudinal arch of a foot, and to transverse arch of a foot, and (c) providing a means for attaching the pads to the carrier, and (d) beginning the method by applying substantially simultaneous definite pressures by standing on the pads, the application of pressures being sufficient in intensity and duration to substantially effect the bony alignment of a person's feet, (e) beginning the definite pressures with the medial longitudinal arch at a forward area substantially underlying the first metatarsal and first cuneiform bones and concluding with a rearward area, substantially underlying the talus bones, then applying pressures to the lateral longitudinal arch areas beginning with a rearward area substantially underlying the junction between the cuboid and calcaneus bones, and concluding with a forward area substantially underlying the center of the fourth metatarsal bones, and then applying pressures to the longitudinal center including the transverse arches beginning with a forward area substantially underlying the center of the second metatarsal bones and concluding with a rearward area substantially underlying the junction of the talus, cuboid and calcaneum bones, then (f) concluding the method by removing pressure from the area underlying the junction of the talus, cuboid and calcaneum bones, first by removing the user's handedness side of the body's foot or the ipsilateral foot of the handedness side of the body from a pad, and then finally removing the user's other foot from a pad, whereby foot alignment is substantially improved as evidenced through applied kinesiology manual muscle testing procedures.

9. A method as set forth in claim 8 including applying an additional set of applied pressures to each of the arches, substantially underlying the middle portion of each arch, including the position underlying the navicular bones of the medial longitudinal arch, the position underlying the junction between the fifth metatarsal and cuboid bones of the lateral longitudinal arch, and the position underlying the junction between the second and third cuneiform bones of the transverse arch or longitudinal center of the foot.

10. A method as set forth in claim 8 including the placement of the carrier surface on or within single step away from a floor which is sufficiently resilient to maintain the bony realignment of the foot effected by the method, so that the user maintains this bony repositioning when stepping off the floorboard onto a sufficiently resilient floor, so as to not negate the benefits of the methodological repositioning.

11. A method as set forth in claim 8 providing indicia on the upper surface of the carrier surface to assist in the placement of feet on the pads for the application of a sequence of specific forces to the arches of the feet as indicated by the specific methodology.

12. A method as set forth in claim 8 providing a carrier surface which is a strap, whereby the carrier surface is then place on a floor sufficiently resilient in order to substantially maintain the adjustment of the bony architecture of the feet effected by the method.

13. A method as set forth in claim 8 providing a means for adhesively attaching the pads to the carrier, and attaching the pads to a resilient disc means for increasing or decreasing the height of the pads relative to the floor or floorboard surface, such that the pads are removable and adjustable by increasing or decreasing the number of resilient discs located under the pads.

14. A method as set forth in claim 8 in which the definite pressures are applied in a direction generally perpendicular to the bottom surface of the user's foot.

* * * * *